US005799418A

United States Patent [19]

Davis

[11] Patent Number: 5,799,418

[45] Date of Patent: Sep. 1, 1998

[54] FOOTWEAR DEVICE FOR REDUCING WALKING RELATED NOISE

[76] Inventor: Richard P. Davis, 6942 FM 1960 E. #157, Humble, Tex. 77346

[21] Appl. No.: 685,521

[22] Filed: Jul. 24, 1996

[51] Int. Cl.[6] ..... A43B 5/18; A43B 3/16

[52] U.S. Cl. ..... 36/116; 36/7.1 R; 36/9 R

[58] Field of Search ..... 36/9 R, 84, 116, 36/7.1 R; 15/227

[56] References Cited

U.S. PATENT DOCUMENTS

| | | | |
|---|---|---|---|
| 1,494,653 | 5/1924 | Walters | 36/7.1 R |
| 2,571,606 | 10/1951 | Peterson | 15/227 |
| 2,738,533 | 3/1956 | Peterson | 36/15 X |
| 2,784,436 | 3/1957 | Peterson | 15/227 |
| 3,863,272 | 2/1975 | Guille | 36/9 R X |
| 4,893,421 | 1/1990 | Folks . | |
| 5,024,008 | 6/1991 | Maples . | |
| 5,168,643 | 12/1992 | Laurain . | |

*Primary Examiner*—Ted Kavanaugh

*Attorney, Agent, or Firm*—Pravel, Hewitt, Kimball & Krieger

[57] ABSTRACT

A footwear device for reducing noise caused when an outdoorsman walks over leaves, twigs, and other ground objects and additionally serves to conceal an outdoorsman's feet from visual detection. The footwear device can be slipped on over an outdoorsman's shoes or can be worn over the bare or socked feet as a moccasin. The footwear device comprises a camouflaged cloth upper body portion for covering and concealing the shoe or foot, an adjustable opening for receiving the shoe or foot into the footwear device, a means for securing which firmly holds the device in place around the shoe or foot, and a bottom sole comprised of a synthetic fur material that reduces noise occurring when the outdoorsman steps on ground objects. In addition to suppressing walking related noise and concealing the feet, the present invention is supple to facilitate carrying, easy to put on, and to remove.

16 Claims, 1 Drawing Sheet

FOOTWEAR DEVICE FOR REDUCING WALKING RELATED NOISE

SPECIFICATION

FIELD OF THE INVENTION

This invention relates to footwear for outdoorsmen. More specifically, the invention relates to a footwear device used by outdoorsmen to reduce noise caused by walking over ground objects such as leaves and twigs.

BACKGROUND OF THE INVENTION

The success of many outdoor activities such as hunting, bird watching, or photography depends in large part upon how close the outdoorsman can get to wild animals or birds. Whether shooting a rifle or a camera, outdoorsmen must stalk or pursue an animal to get into position to accomplish their objectives. However, mobility often is accompanied by a certain amount of noise as the outdoorsman walks over leaves, twigs, and other ground objects. This noise can alert animals or birds to the outdoorsman's presence and can prevent the outdoorsman from getting into the desired position.

Various attempts have been made to suppress this walking related noise. In U.S. Pat. No. 4,893,421 disclosed was a shoe or boot attachment that consisted of a flexible wall which surrounded the outside perimeter of a shoe and extended below the bottom surface of the shoe to form a cavity. This invention purported to suppress sounds that were generated within the perimeter of the shoe attachment. U.S. Pat. No. 5,168,643 disclosed a hunting shoe or shoe attachment which had sound absorbing material covering the lower portion of the shoe which was surrounded on the sides by a rigid housing. Below the sound absorbing material was a thin walls with a plurality of apertures. This combination purported to dampen the sounds caused by contact of the shoe with ground objects.

In addition to noise related concerns with stalking, outdoorsman have also found that animals can detect their presence visually. To reduce visual detection, outdoorsman have camouflaged their apparel to match the surroundings. Camouflaged materials have been generally composed of various patterns of colors such as greens, browns, blacks, and other earth tones which easily blend in with the surroundings.

SUMMARY OF THE INVENTION

The present invention provides a footwear device for reducing noise caused when an outdoorsman walks over ground objects such as leaves and twigs and additionally serves to conceal an outdoorsman's feet from visual detection. The footwear device can be slipped on over an outdoorsman's shoes or can be worn over bare or socked feet as a moccasin. The footwear device comprises a camouflaged cloth upper body for covering and concealing the shoe, an adjustable opening for inserting the shoe into the footwear device, a means for securing which firmly holds the device in place around the shoe or foot, and a bottom sole comprised of a synthetic fur material that reduces noise occurring when the outdoorsman steps on ground objects. In addition to suppressing walking related noise and concealing the feet, the present invention is supple to facilitate carrying, easy to put on, and easy to remove.

BRIEF DESCRIPTION OF THE DRAWINGS

A better understanding of the invention can be obtained when the detailed description set forth below is reviewed in conjunction with the accompanying drawings, in which.

DETAILED DESCRIPTION OF PREFERRED EMBODIMENT

Figure 1:
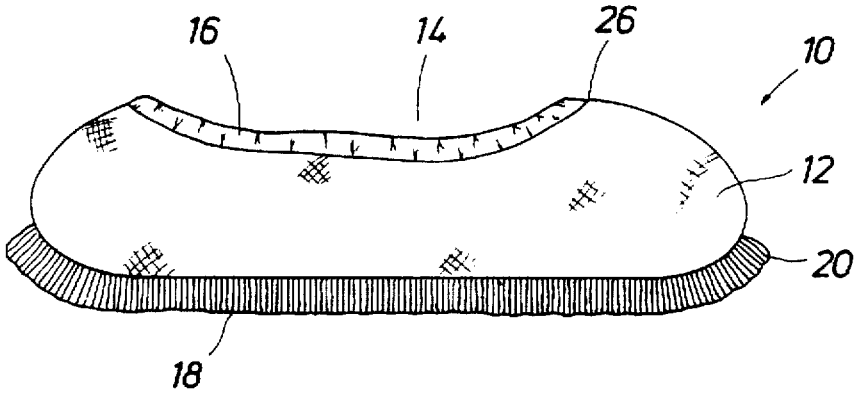
FIG. 1 is an side view of an embodiment of the present invention.
Figure 2:
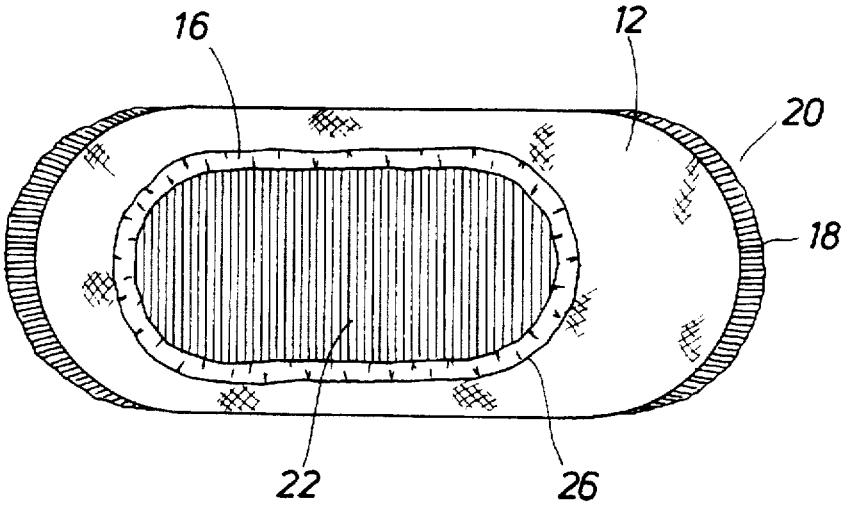
FIG. 2 is a top view of an embodiment of the present invention.
Figure 3:
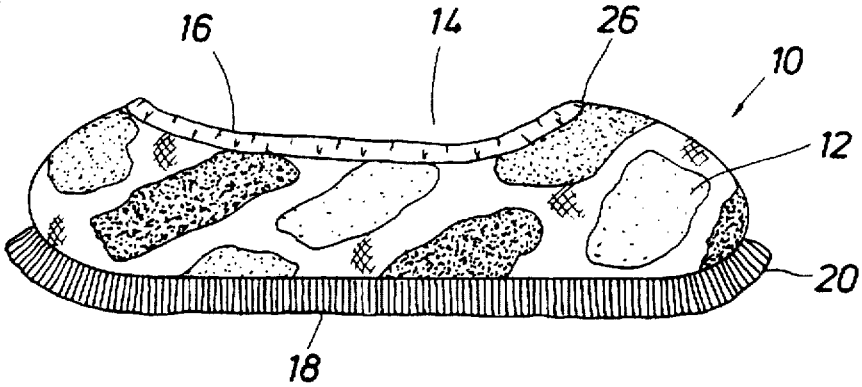
FIG. 3 is a side view of the preferred embodiment of the present invention.

As shown in FIGS. 1–3, the present invention is footwear device 10 for outdoorsmen. The term "outdoorsman" or "outdoorsmen" as used herein is gender neutral, applying equally to persons of both sexes. The footwear device 10 reduces noise caused when an outdoorsman walks over objects such as leaves and twigs or other ground cover and additionally serves to conceal an outdoorsman's shoes from visual detection. The footwear device can be slipped on over an outdoorsman's shoes or can be worn over the feet as a moccasin. As used in this specification, the term "shoe" encompasses all types of footwear including shoes, boots, sandals, etc. and in addition, includes bare or socked feet when the footwear device is being used as a moccasin.

Referring to FIGS. 1 and 2, the footwear device 10 comprises a cloth upper body 12 for covering and concealing a shoe, an adjustable opening 14 for inserting the shoe into the footwear device 10, a means for securing 16 which firmly holds the device 10 in place around the shoe, and a bottom sole 20 comprised of a synthetic fur material 18 that reduces noise occurring when the outdoorsman steps on ground objects and a fur material backing 22.

The upper body 12 of the footwear device 10 is formed from a cloth material. In FIGS. 1 and 2, the cloth material can be a solid color, such as green, to visually blend the shoe into the landscape. As shown in FIG. 3, the cloth material used to form the upper body 12 preferably has a camouflage pattern and is the same or similar in appearance and consistency to cloths commonly used in camouflaged hunting clothing. The camouflage pattern on the cloth material helps conceal the outdoorsman's shoes from visual detection. The cloth material should be durable and preferably capable of being washed. The upper body 12 may be made of two layers of the cloth material to increase durability.

The upper edge 26 of the upper body 12 defines an opening 14 through which the outdoorsman's foot can be inserted into the footwear device 10. The footwear device 10 also has a means of securing 16 the footwear device tightly about the outdoorsman's shoe. In the preferred embodiment, the means of securing 16 is a resilient band (not shown) affixed inside the upper portion 26 of the upper body 12 which forms the opening 14. Other means of securing may including elastic, strings, buttons, clasps, snaps, or other fastening devices which can be used to tightly secure the footwear device to an outdoorsman's shoe.

The bottom sole 20 comprises a synthetic fur material 18 which will contact the ground and any ground objects when the outdoorsman walks and a fur material backing 22 which is direct contact with the sole or bottom of the outdoorsman's shoe when the footwear device 10 is being worn. The fur material backing 22 may be integral with the fur material 18. The synthetic fur 18 is a supple knitted pile fabric capable of absorbing or muffling sound. Preferably, the synthetic fur material 18 is a polyester knitted pile fabric with about 4.0 to 8.0 Denier coarseness and about 0.75 to 1.75 inches pile height. More preferably, the polyester knitted fabric has about a 6.0 Denier coarseness and about a 1.25 inches pile height. Other knitted fabrics such as those formed from acrylic, nylon, polyolefins, or blends of these materials are also acceptable. The coarseness of the fibers and the pile height can be varied for different fabrics.

An advantage of the present invention over prior art devices is that the present invention is easily stowed and easily slipped over the outdoorsman's shoes. The supple or flexible materials used in the present invention allows it to be folded or rolled for easy carrying in jacket pockets, backpacks, etc. An outdoorsman may walk without wearing the present invention until it becomes necessary to begin stalking his prey. The present invention can then easily be taken out and slipped over the outdoorsman's shoes for stalking or making a quiet approach to an animal or bird.

It should be noted and understood that there can be improvements and modifications made of the embodiments of the invention described in detail above without departing from the spirit or scope of the invention as set forth in the accompanying claims.

What is claimed is:

1. A device for reducing noise caused by outdoorsmen stepping on ground objects when stalking animals, comprising:

a flexible upper body portion adapted to cover a shoe comprising a cloth material having a camouflage pattern to conceal the device in an outdoor environment, the flexible upper body portion having an opening adapted to receive the shoe inside the upper body portion, the flexible upper body portion including a means for securing the device tightly in place about the shoe, and a bottom sole section attached to the flexible upper body portion, the bottom sole section comprising a synthetic fur material for absorbing sound and reducing walking related noise.

2. The device of claim 1, wherein the synthetic fur material comprises a knitted pile fabric.

3. The device of claim 1 wherein the camouflage pattern comprises color images of greens and browns.

4. The device of claim 1 wherein the camouflage pattern consists of color images selected from the group of greens, browns, tans, and blacks.

5. A device for reducing noise caused by outdoorsmen stepping on ground objects when stalking animals, comprising:

an upper body portion adapted to cover a shoe comprising a cloth material having a camouflage pattern to conceal the device in outdoor environments, the flexible upper body portion having an opening adapted to receive the shoe inside the upper body portion, a resilient banding surrounding the opening for securing the device tightly in place about the shoe, and a bottom sole section attached to the upper body portion, the bottom sole section comprising a synthetic fur material for absorbing sound and reducing walking related noise.

6. The device of claim 5 wherein the synthetic fur material is a synthetic knitted pile fabric.

7. The device of claim 6 wherein synthetic knitted pile fabric is formed from polyester fibers.

8. The device of claim 6 wherein the synthetic knitted pile fabric has a pile height of between about 0.75 and about 1.75 inches.

9. A device for reducing noise caused by outdoorsmen stepping on ground objects when stalking animals, comprising:

an upper body portion adapted to cover a shoe comprising a cloth material having a camouflage pattern to conceal the device in outdoor environments, the flexible upper body portion having an opening adapted to receive the shoe inside the upper body portion, a resilient banding surrounding the opening for securing the device tightly in place about the shoe, and a bottom sole section attached to the upper body portion, the bottom sole section comprising a synthetic knitted pile fabric for absorbing sound and reducing walking related noise.

10. The device of claim 9 wherein the bottom sole section further comprises a material backing for directly contacting a bottom portion of the shoe, the material backing being integral with the knitted pile fabric.

11. The device of claim 9 wherein the camouflage pattern comprises color images of greens and browns.

12. The device of claim 9 wherein the camouflage pattern consists of color images selected from the group of greens, browns, tans, and blacks.

13. The device of claim 9 wherein the synthetic knitted pile fabric is formed from polyester fibers.

14. The device of claim 9 wherein the synthetic knitted pile fabric has a pile height of between about 0.75 and about 1.75 inches.

15. The device of claim 9 wherein the synthetic knitted pile fabric has coarseness of between about 4.0 and about 8.00 denier.

16. The device of claim 9 wherein the upper body portion and the bottom sole portion comprise flexible materials capable of being folded for carrying.

* * * * *